US006130695A

United States Patent [19]

Childers et al.

[11] Patent Number: 6,130,695

[45] **Date of Patent: *Oct. 10, 2000**

[54] INK DELIVERY SYSTEM ADAPTER

[75] Inventors: Winthrop D. Childers, San Diego, Calif.; Bruce Cowger, Corvallis, Oreg.; Michael L. Bullock, San Diego, Calif.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/034,874

[22] Filed: Mar. 4, 1998

Related U.S. Application Data

[63] Continuation-in-part of application No. 08/785,580, Jan. 21, 1997, Pat. No. 5,812,156, and a continuation-in-part of application No. 08/429,915, Apr. 27, 1995, Pat. No. 5,825,387, and a continuation-in-part of application No. 08/566,818, Dec. 4, 1995, Pat. No. 5,900,896, and a continuation-in-part of application No. 08/869,151, Jun. 4, 1997, Pat. No. 5,844,580.

[51] Int. Cl.[7] ..... B41J 2/175

[52] U.S. Cl. ..... 347/85

[58] Field of Search ..... 347/85, 86, 87, 347/50, 49; 439/660, 295, 862

[56] References Cited

U.S. PATENT DOCUMENTS

| | | | |
|---|---|---|---|
| 3,950,761 | 4/1976 | Kashio | 347/85 |
| 4,629,164 | 12/1986 | Sommerville | 239/69 |
| 5,068,806 | 11/1991 | Gattan | 395/113 |
| 5,098,311 | 3/1992 | Roath et al. | 439/289 |
| 5,138,344 | 8/1992 | Ujita | 347/86 |
| 5,414,452 | 5/1995 | Accatino et al. | 347/7 |
| 5,506,611 | 4/1996 | Ujita et al. | 347/86 |
| 5,721,576 | 2/1998 | Barinaga | 347/85 |
| 5,825,401 | 10/1998 | Wadley et al. | 347/247 |
| 5,921,787 | 7/1999 | Pope et al. | 439/74 |

FOREIGN PATENT DOCUMENTS

| | | | |
|---|---|---|---|
| 0440261 | 2/1991 | European Pat. Off. | B41J 2/175 |
| 0739740 | 12/1995 | European Pat. Off. | B41J 2/175 |
| 0720916 | 7/1996 | European Pat. Off. | B41J 2/175 |
| 0778148 | 9/1996 | European Pat. Off. | B41J 2/175 |
| 0739740 | 10/1996 | European Pat. Off. . | |
| 0789322 | 1/1997 | European Pat. Off. | G06K 15/00 |
| 2321623A | 1/1998 | United Kingdom | B41J 2/175 |
| 2321623 | 8/1998 | United Kingdom . | |
| WO98/31548 | 12/1997 | WIPO | B41J 25/34 |
| WO98/55324 | 6/1998 | WIPO | B41J 2/175 |
| 98/31548 | 7/1998 | WIPO . | |
| 98/55324 | 10/1998 | WIPO . | |

OTHER PUBLICATIONS

Copy of the European Search Report mailed Jun. 10, 1999 (5 pages).

*Primary Examiner*—N. Le
*Assistant Examiner*—Michael Nghiem
*Attorney, Agent, or Firm*—Kevin B. Sullivan

[57] ABSTRACT

A variety of adaptive ink delivery systems for an existing ink-jet printing system are usable in lieu of an original equipment ink cartridge. Each adaptive ink delivery system has an ink reservoir in communication with a fluid outlet configured to couple with the fluid inlet on the printing system. Each ink delivery system also has an electrical adapter connector which mates with an electrical connector on the printing system. Each ink delivery system has an information storage device to exchange enabling information with a controller of the printing system. The information storage device may be an emulation circuit that provides enabling information to the printing system regardless of the actual condition of the ink reservoir. The adaptive supplies allow the information storage device and/or the replacement ink reservoir to be located on or optionally remotely from the printing system.

8 Claims, 12 Drawing Sheets

Fig. 14
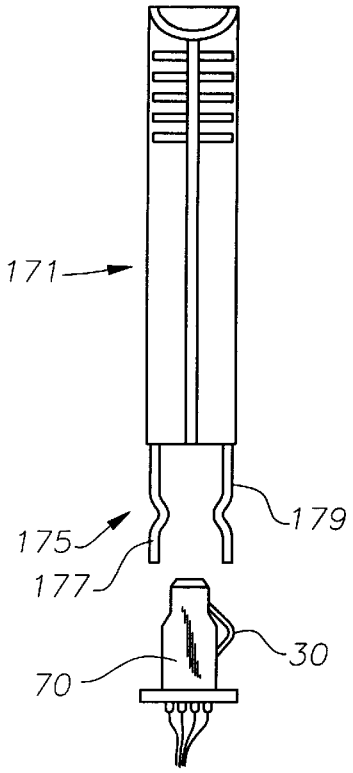
Fig. 15
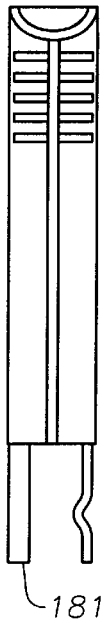
Fig. 16
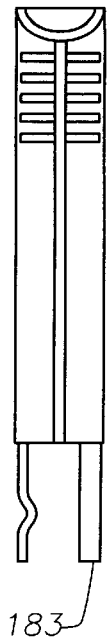
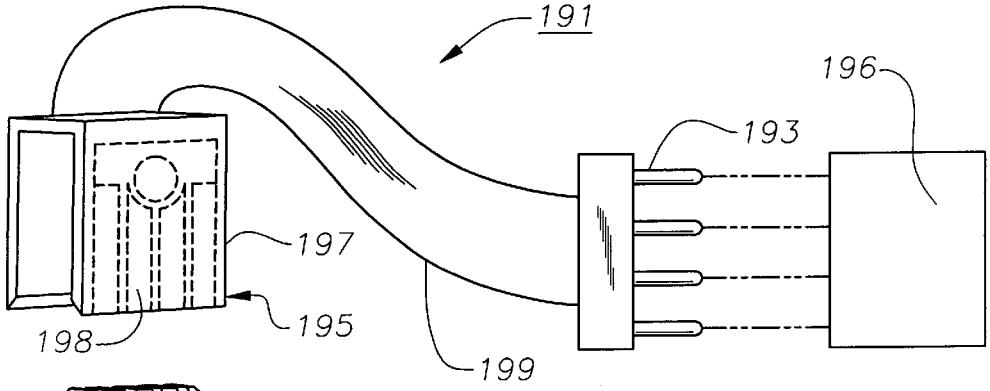
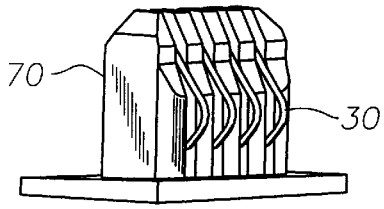
Fig. 17

INK DELIVERY SYSTEM ADAPTER

CROSS REFERENCE TO RELATED APPLICATIONS

This application is a continuation-in-part of U.S. patent application Ser. No. 08/785,580, [now U.S. Pat. No. 5,812,156], filed Jan. 21, 1997, "Apparatus Controlled by Data From Consumable Parts With Incorporated Memory Devices" now U.S. Pat. No. 5,812,156 (issued Sep. 22, 1998).

This application is also a continuation-in-part of U.S. patent application Ser. No. 08/429,915, entitled "Ink Supply For An Ink-Jet Printer" filed Apr. 27, 1995, now U.S. Pat No. 5,825,387 (issued Oct. 20, 1998), and a continuation-in-part of U.S. patent application Ser. No. 08/566,818, entitled "Ink Cartridge Adapters" filed Dec. 4, 1995, now U.S. Pat. No. 5,900,896 (issued May 4, 1999), and a continuation-in-part of U.S. patent application Ser. No. 08/869,151, entitled "Ink Container Configured For Use With A Printing Device Having An Out-of-Ink Sensing System" filed Jun. 4, 1997, now U.S. Pat. No. 5,844,580 (issued Dec. 1, 1998). Also, this application is related to commonly assigned patent application attorney docket number 10971934-1,U.S. application Ser. No. 09/034,875, filed Mar. 4, 1998, entitled "Electrical Refurbishment for Ink Delivery System " and to patent application attorney docket number 10971937-1, U.S. application Ser. No. 09/034,719, filed May 4, 1998, entitled "Ink Container Refurbishment Method". Both applications are filed concurrently with this application and are incorporated herein by reference.

TECHNICAL FIELD

This invention relates in general to providing an adaptive ink supply in lieu of an original equipment ink cartridge for an ink jet printing system, particularly wherein the ink cartridge has a memory device that exchanges information with the printing system.

BACKGROUND OF THE DISCLOSURE

One type of ink-jet printing system has a printhead mounted to a carriage that is moved back and forth over a print media, such as paper. As the printhead passes over appropriate locations on the print media, a control system activates the printhead to eject ink drops onto the printing surface and form desired images and characters. To work properly, such printing systems must have a reliable supply of ink for the printhead.

One category of ink-jet printing system uses an ink supply that is mounted to and moves with the carriage. In some types, the ink supply is replaceable separately from the printhead. In others, the printhead and ink supply together form an integral unit that is replaced once the ink in the ink supply is depleted.

Another category of printing system uses ink supplies that are not located on the carriage. One type replenishes the printhead intermittently. The printhead will travel to a stationary reservoir periodically for replenishment. Another type, referred to as a replaceable off-axis ink supply, has a replaceable ink cartridge or container connected to the printhead by a fluid conduit. The ink cartridge has a fluid reservoir filled with ink and located within a housing. The reservoir has a fluid coupling mechanism for coupling the reservoir to the printing system so that ink may flow from the reservoir to the printhead. The reservoir is sometimes pressurized in some manner to provide a reliable high flow rate supply of ink to the printhead.

In the parent application to this application, application Ser. No. 08/785,580, a replaceable off-axis cartridge is described which has a memory device mounted to the housing. When inserted into the printing system station, an electrical connection between the printing system and the memory device is established. This electrical connection allows for the exchange of information between the printing system and the memory. The memory device stores information that is utilized by the printing system to ensure high print quality. This information is provided to the printing system automatically when the cartridge is mounted to the printing system. The exchange of information assures compatibility of the cartridge with the printing system. The stored information includes helpful information, such as the date when the cartridge was first installed on a printing system. This installation date can be used to deduce how long the cartridge has been installed and hence whether the ink contained in the cartridge may be beyond shelf life.

The stored information further prevents the use of the cartridge after it is depleted of ink. Operating a printing system when the reservoir has been depleted of ink can destroy the printhead. The memory devices concerned with this application are updated with data from the printhead concerning the amount of ink left in the reservoir as it is being used. When a new cartridge is installed, the printing system will read information from the memory device indicative of the reservoir volume. During usage, the printing system estimates ink usage and updates the memory device to indicate how much ink is left in the cartridge. When the ink is substantially depleted, this type of memory device can store data indicative of an out of ink condition. When substantially depleted of ink, these cartridges are typically discarded and a new cartridge along with a new memory device is installed.

The ink containers described in the parent application have fixed volumes of deliverable ink that have been provided for printing systems based generally on ink usage rate requirements of a particular user. However, printing systems users have a wide variety of ink usage rates that may change over time. For ink-jet printing system users who require relatively high ink usage rates, ink containers having these volumes require a relatively high ink container replacement rate. This can be especially disruptive for print jobs which are left to run overnight. Extended continuous use of printing systems causes ink containers to run out of ink during a print job. If the printing system does not shut down during an "ink out" condition, the printhead or the printing system itself may be permanently damaged.

For printing system users who require lower volumes of ink, a different set of problems is encountered if the ink volume is too large. The ink may surpass its shelf life prior to being utilized. Larger ink cartridges are more expensive and bulkier than smaller cartridges and may be cost prohibitive to small volume users. Thus, a need exists for providing adaptive ink supplies for the ink cartridge described in the parent application, so that ink containers having a variety of ink volumes may be utilized. The adaptive ink supplies should be still able to provide to the printing system the benefits of the memory device of the original equipment ink cartridge.

DISCLOSURE OF THE INVENTION

Multiple embodiments of an adaptive ink delivery system for an existing ink-jet printing system are provided. The adaptive ink delivery systems include ink reservoirs of varying configuration and size that are capable of accommodating a variety of ink use rates. Each adaptive ink delivery system also has an electrical connector and an information storage device which are suitable for the various ink use rates. The information storage device may be a memory device or an emulation circuit that provides the functionality of a memory device but may have a different structure. The adaptive ink delivery systems allow one to locate the ink reservoir and/or the information storage device remotely from the printing system.

BRIEF DESCRIPTION OF THE DRAWINGS

FIG. 14 is a side view of a third embodiment of an adaptive ink container constructed in accordance with the invention.

FIG. 15 is a side view of a fourth embodiment of an adaptive ink container constructed in accordance with the invention.

FIG. 16 is a side view of a fifth embodiment of an adaptive ink container constructed in accordance with the invention.

FIG. 17 is an enlarged side view of an electrical connector adapter for connecting a remote memory device to the printing system of FIGS. 1–10.

BEST MODE FOR CARRYING OUT THE INVENTION

Although the present invention comprises adapters and methods for altering the volume of ink and the corresponding informational requirements supplied to a printing system, the invention may be more clearly understood with a thorough discussion of the printing system and an initial ink container.

Figure 1:
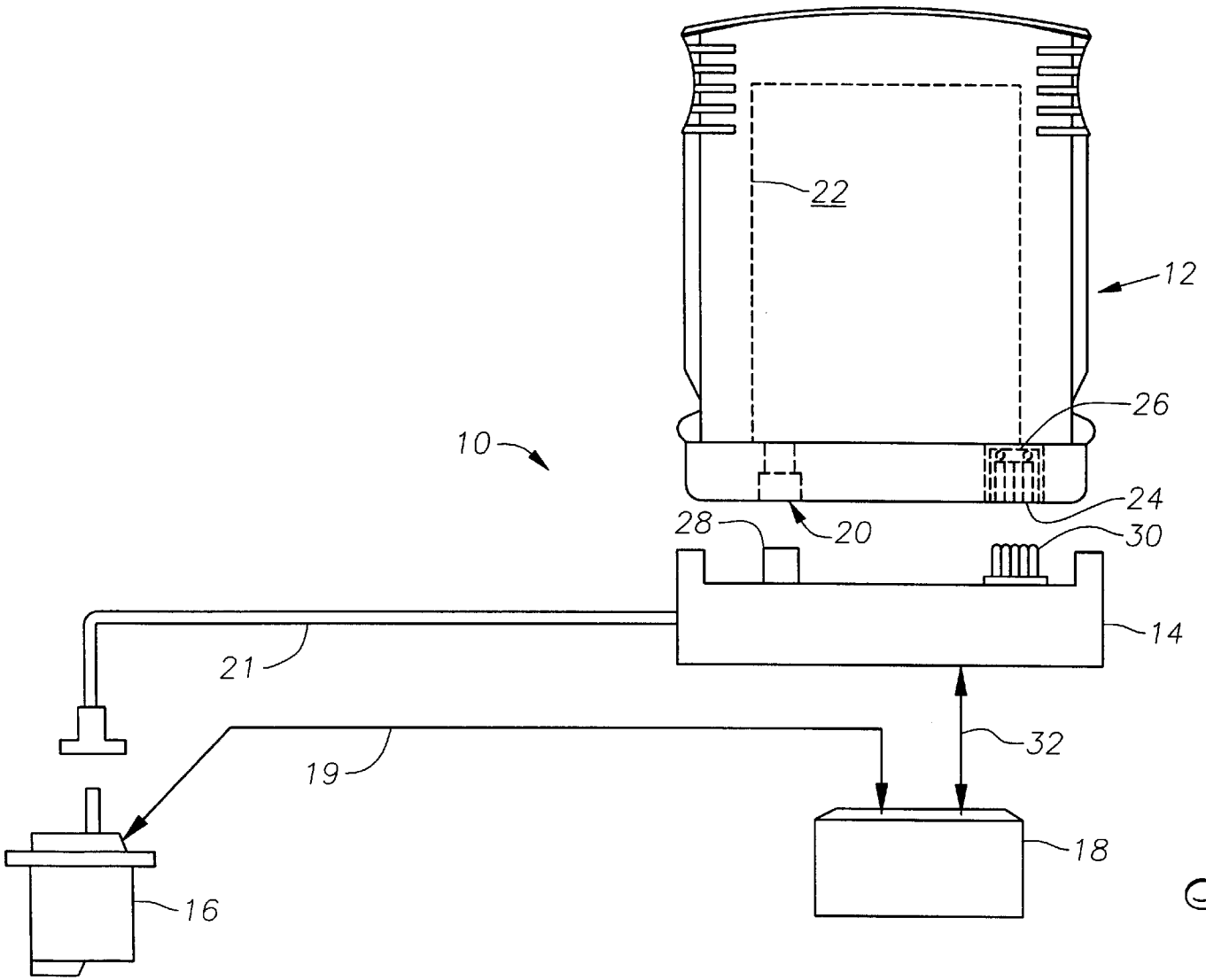
FIG. 1 is a schematic representation of a printing system showing an ink container which forms a fluid interconnect and an electrical interconnect with the printing system.

FIG. 1 illustrates a portion of an ink-jet printing system 10 having an ink cartridge or container 12. The ink-jet printing system 10 includes an ink container receiving station 14, an ink-jet printhead 16, and a print controller 18. Printing is accomplished by the ejection of ink from the printhead 16 under the control of print controller 18. Printhead 16 is connected to the controller 18 by link 19 for controlling ejection of ink. Ink is provided to the printhead 16 by way of a fluid conduit 21, which joins the printhead 16 to the receiving station 14. Ink container 12 includes a fluid outlet 20 that communicates with a fluid reservoir 22. Ink container 12 also includes electrical terminals or contacts 24 that communicate with an information storage device 26 such as a memory device.

Fluid outlet 20 and electrical contacts 24 allow ink container 12 to interconnect with a fluid inlet 28 and electrical contacts 30, respectively, on receiving station 14. Receiving station 14 enables ink to be transferred from fluid reservoir 22 to printhead 16 via fluid conduit 21. In addition, receiving station 14 allows the transfer of information between information storage device 26 and print controller 18 via a link 32.

Each ink container 12 has unique ink container-related aspects that are represented in the form of data provided by information storage device 26. This data is provided from ink container 12 to printing system 10 via information storage device 26 automatically without requiring the user to reconfigure printing system 10 for the particular ink container 12 installed. The data provided may be indicative of the ink container manufacturer identity, type of ink, and date code of the ink container 12. In addition, the data provided may include system parameters, such as system coefficients and service mode.

Figure 7:
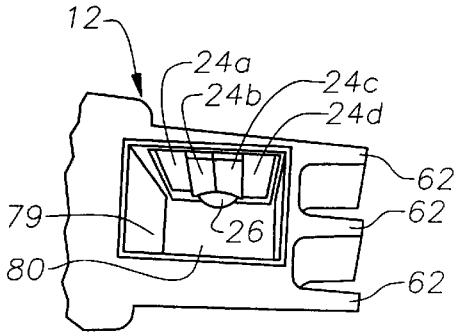
FIG. 7 is an enlarged bottom view of the ink container of FIG. 1, showing detail of the electrical interconnect portion of the ink container.

Printing system 10 monitors the level of deliverable ink in ink container 12 via information storage device 26. Information storage device 26 stores volume information indicative of the level of deliverable ink in ink container 12. Printing system 10 updates this volume information by altering memory device 26 and queries this volume information by receiving data from memory device 26. In a preferred embodiment, communication including transfer of data between printing system 10 and information storage device 26 is accomplished in serial fashion along the single data line 24*d* relative to ground (FIG. 7).

In a preferred embodiment, the volume information includes the following: (1) initial supply size data in a write protected portion of memory, (2) coarse ink level data stored in write once portion of memory, and (3) fine ink level data stored in a write/erase portion of memory. The initial supply size data is indicative of the amount of deliverable ink initially present in ink container 12.

The coarse ink level data includes a number of write once bits that each correspond to some fraction of the deliverable ink initially present in ink container 12. In a first preferred embodiment, eight coarse ink level bits each correspond to one eighth of the deliverable ink initially in ink container 12. In a second preferred embodiment, to be used in the discussion that follows, seven coarse ink level bits each correspond to one eighth of the deliverable ink initially present in ink container 12 and one coarse ink level bit corresponds to an out of ink condition. However, more or less coarse bits can be used, depending on the accuracy desired for a coarse ink level counter.

The fine ink level data is indicative of a fine bit binary number that is proportional to a fraction of one eighth of the volume of the deliverable ink initially present in ink container 12. Thus, the entire range of the fine bit binary number is equivalent to one coarse ink level bit. This will be further explained below.

Printing system 10 reads the initial supply size data and calculates the amount or volume of deliverable ink initially present in ink container 12. An estimated drop volume ejected by the printhead 16 is determined by printing system 10 by reading parameters and/or performing calculations. Using the initial volume of deliverable ink in ink container 12 and the estimated drop volume of printhead 16, the printing system 10 calculates the fraction of the initial deliverable ink volume that each drop represents. This enables the printing system 10 to monitor the fraction of the initial volume of deliverable ink remaining in ink container 12.

While printing, printing system 10 maintains a drop count equal to the number of ink drops that have been ejected by printhead 16. After printing system 10 has printed a small amount, typically one page, it converts the drop count to a number of increments or decrements of the fine bit binary number. This conversion utilizes the fact that the entire range of the fine bit binary number corresponds to one eighth of the initial volume of deliverable ink in ink container 12. Each time the fine bit binary number is fully decremented or incremented, the printing system 10 writes to one of the coarse ink level bits to "latch down" the bit.

Printing system 10 periodically queries the coarse and fine ink level bits to determine the fraction of the initial deliverable ink that is remaining in ink container 12. Printing system 10 can then provide a "gas gauge" or other indication to a user of printing system 10 that is indicative of the ink level in ink container 12. In a preferred embodiment, the printing system provides a "low ink warning" when the sixth (second to last) coarse ink level bit is set. Also in a preferred embodiment, the printing system sets the eighth (last) coarse ink level bit when the ink container 12 is substantially depleted of ink. This last coarse ink level bit is referred to as an "ink out" bit. Upon querying the coarse ink level bits, the printing system interprets a "latched down" ink out bit as an "ink out" condition for ink container 12.

Figure 2:
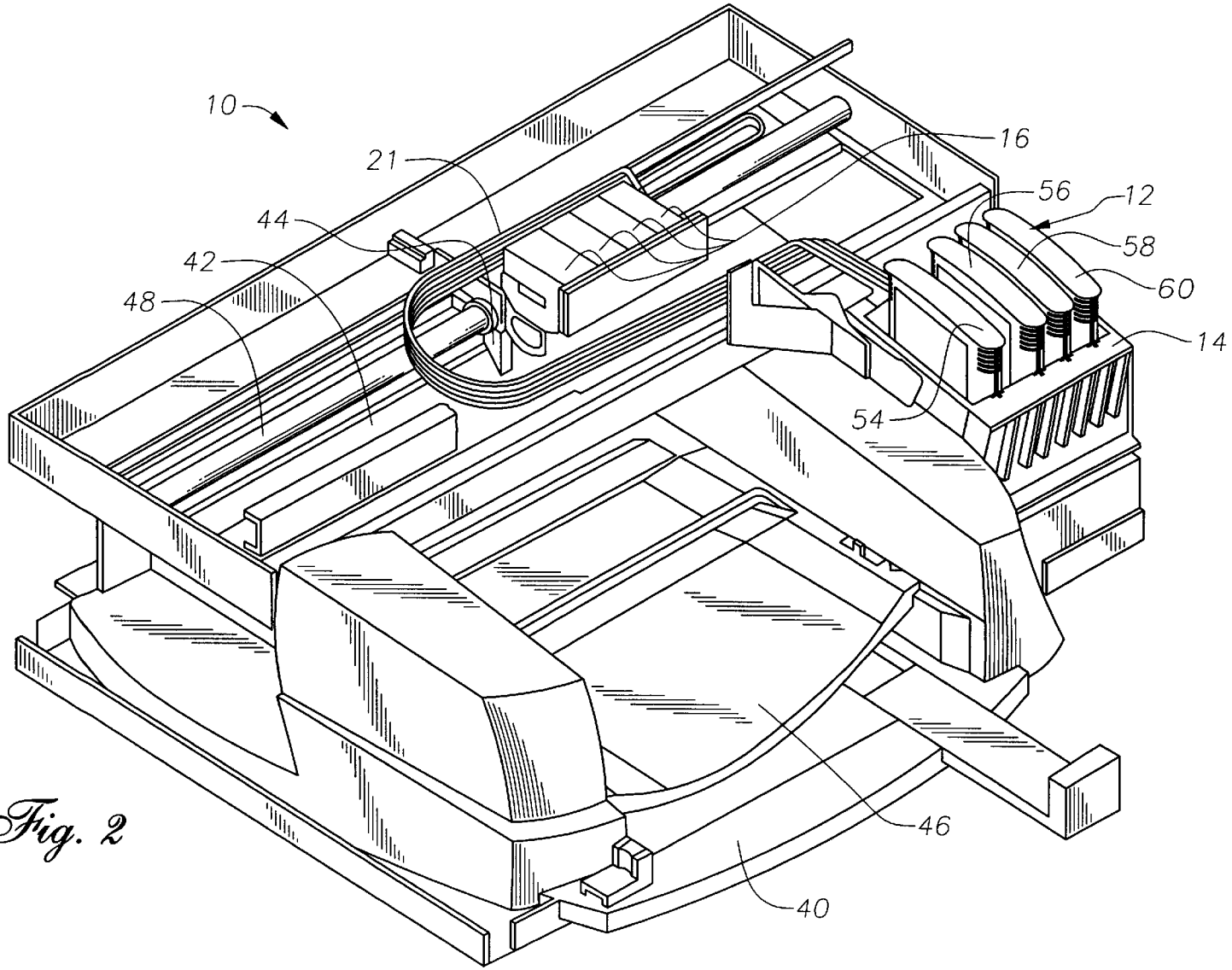
FIG. 2 is an isometric view of a preferred embodiment of the printing system represented in FIG. 1.

Referring now to FIG. 2, a preferred embodiment of printing system 10, with its cover removed, is capable of holding four ink containers 12 at the same time. Printing system 10 includes a tray 40 for holding a paper supply. When a printing operation is to be initiated, a sheet of paper from tray 40 is fed into printing system 10 using a sheet feeder (not shown).

During printing, the paper passes through a print zone 42 whereupon a scanning carriage 44 containing one or more printheads 16 is scanned across the sheet for printing a swath of ink thereon. The sheet of paper is stepped through the print zone 42 as the scanning carriage 44 prints a series of swaths of ink to form images thereon. After printing is complete, the sheet is positioned into an output tray 46. The positioning of paper supply 40 and output tray 46 can vary depending on the particular sheet feed mechanism used. Scanning carriage 44 slides through the print zone 42 on a scanning mechanism that includes a slide rod 48. A positioning means such as a coded strip (not shown) is used in conjunction with a photo detector for precisely positioning scanning carriage 44. A stepper motor (not shown), connected to scanning carriage 44 using a conventional drive belt and pulley arrangement, is used for transporting scanning carriage 44 across print zone 42. A ribbon cable (not shown) carries electrical signals to the scanning carriage 44 for selectively energizing the printheads 16 (FIGS. 1 and 2). As the printheads 16 are selectively energized, ink of a selected color is ejected onto the print media as scanning carriage 44 passes through print zone 42.

Figure 3:
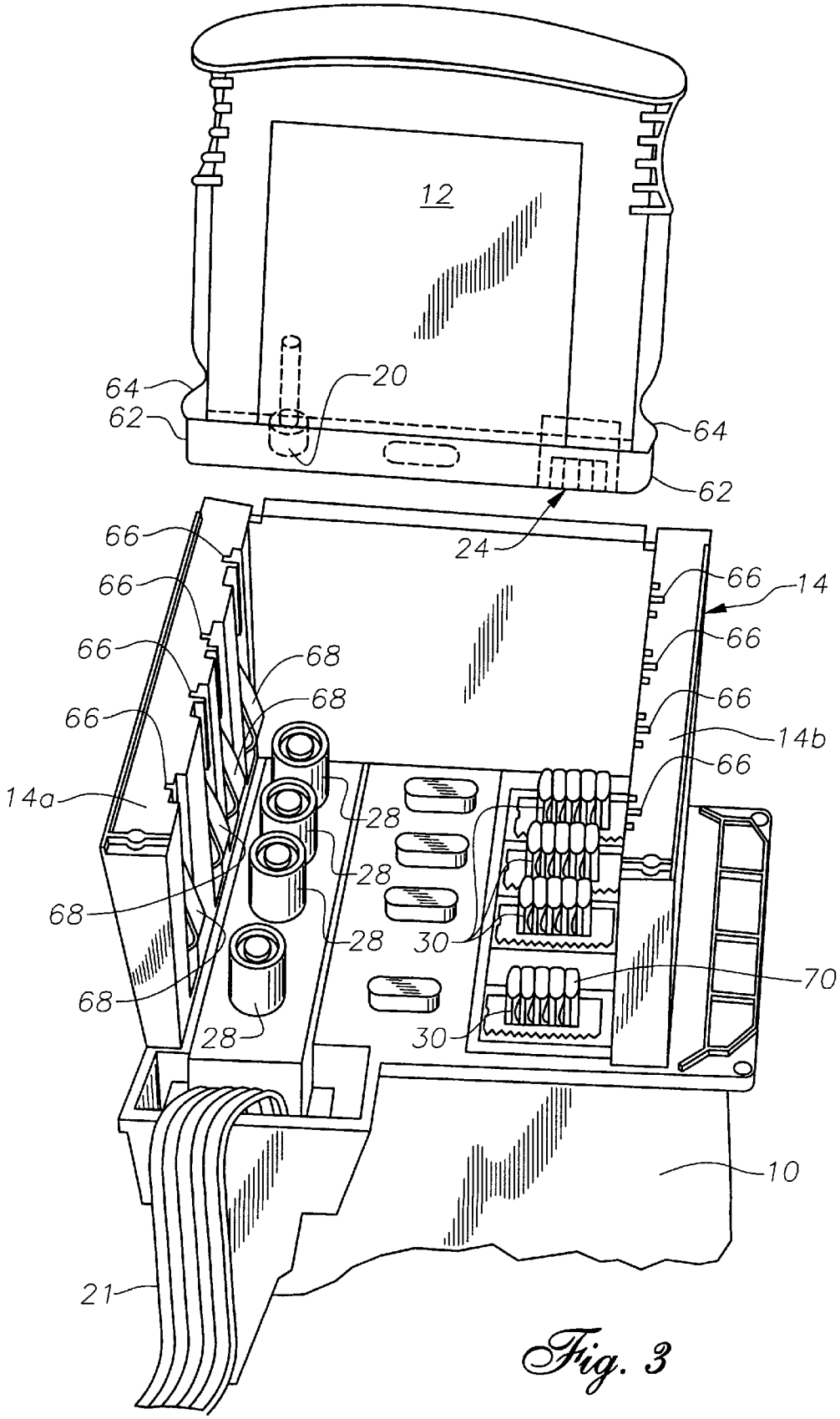
FIG. 3 is an ink container receiving station of the type used in the printer of FIG. 2 shown broken away with an ink supply positioned for insertion into the ink supply receiving station.
Figure 4:
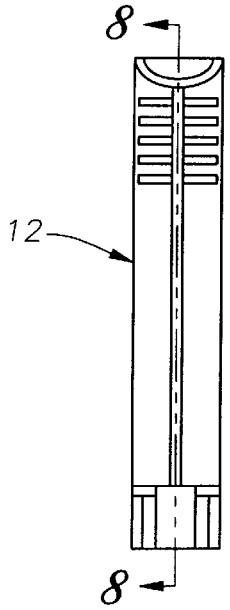
FIG. 4 is a side view of the ink container of FIG. 1.

Each ink container 12 has its own electrical contacts 24 and fluid outlet 20 (FIG. 3). Ink containers 12 may be referred to as an off-axis ink supply since the ink supply is spaced from a scan axis defined by scanning carriage 44. In the case of color printing, ink containers 12 are typically separate ink containers for each color with a container for black ink. For example, ink container 12 for the embodiment shown in FIG. 2 is an ink container 54 for black ink, an ink container 56 for yellow ink, an ink container 58 for magenta ink, and an ink container 60 for cyan ink. Receiving station 14 contains mechanical, fluid and electrical interfaces for each ink container 12. Ink passes through the fluid interfaces in receiving station 14, fluid conduits 21 and then to printheads 16 on print scanning carriage 44.

Referring to FIG. 3, receiving station 14 has a first end 14*a* and a second end 14*b* with inward facing first and second walls, respectively. A plurality of the fluid inlets 28 are located near first end 14*a* for providing ink to a plurality of corresponding printheads 16 via conduits 21 (FIG. 1). A plurality of the electrical contacts 30 is located near the second end 14*b* for providing electrical signals to controller 18 (FIG. 1). Each fluid inlet 28 is located as far from electrical contacts 30 as possible to prevent contamination of contacts 30 with ink from fluid inlets 28.

As shown also in FIG. 7, ink container 12 has aligning ribs 62 on each side edge. Aligning ribs 62 mate with slots 66 (FIG. 3) on receiving station 14 to assist in aligning ink container 12 for insertion into receiving station 14. Aligning ribs 62 and slots 66 also provide a keying function to ensure that ink container 12 contains ink having the proper parameters, such as color and ink compatibility with printing system 10. Ink container 12 also has latch shoulders 64 on each side edge, as shown in FIG. 3, which are engaged by resilient latches 68 mounted on the sidewalls of receiving station 14.

Once ink container 12 is aligned and inserted into receiving station 14, latches 68 on receiving station 14 engage corresponding latch shoulders 64 on ink container 12. Insertion of ink container 12 into receiving station 14 forms both electrical and fluid interconnects between contacts 24 and 30, and ports 20 and 28, respectively.

Figure 10:
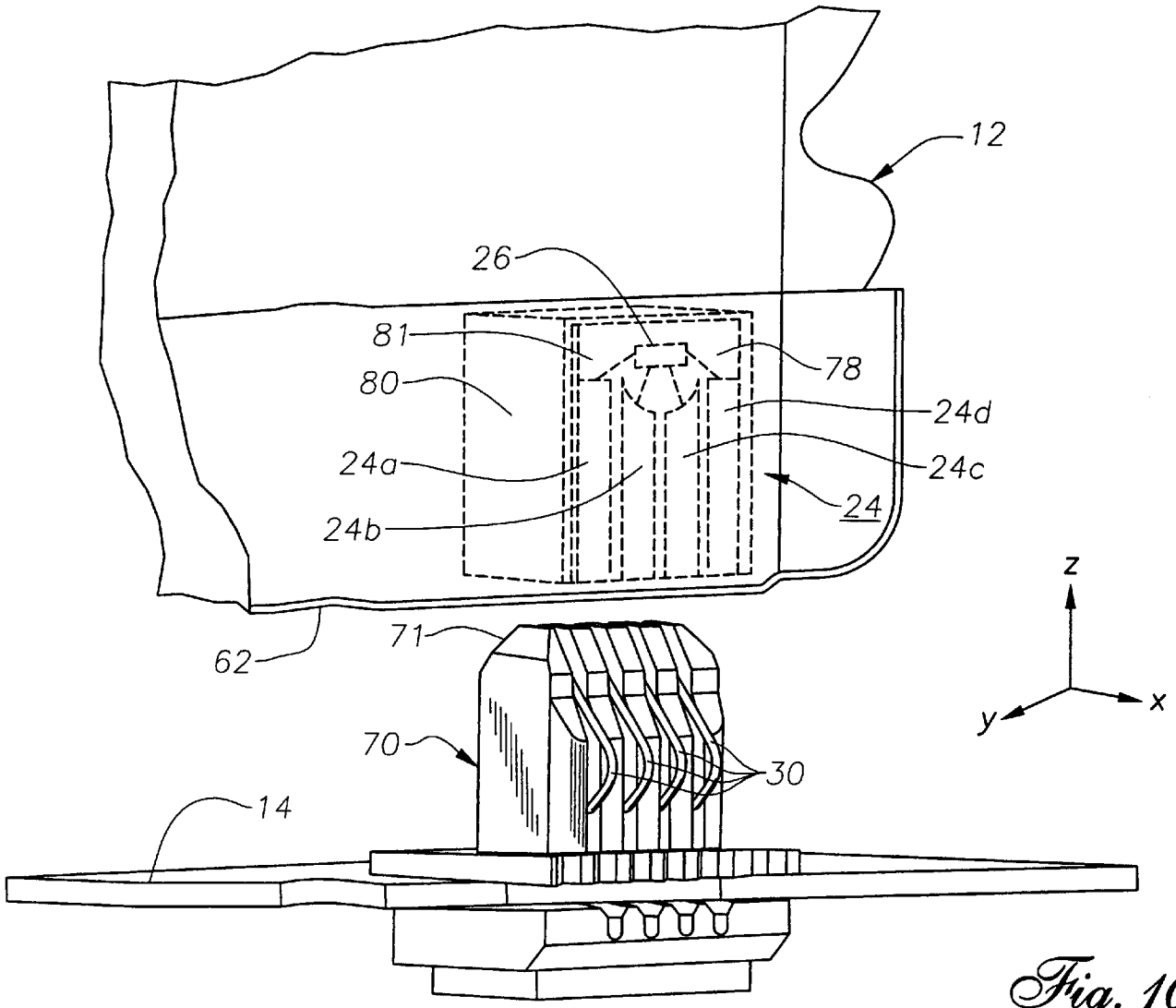
FIG. 10 shows the electrical interface between the ink container and the ink receiving station of FIG. 3 shown greatly enlarged.

Referring to FIG. 3, receiving station 14 has four separate electrical connector posts 70, one for each of the cartridges 12. The four electrical contacts 30 for each cartridge 12 are mounted to each electrical connector post 70, as shown in FIG. 10. Electrical connector posts 70 are substantially free to float in a plane that is substantially perpendicular with respect to a direction of insertion of ink container 12 into receiving station 14. The direction of insertion of ink container 12 is indicated as the z-axis, and the plane in which connector post 70 floats is indicated by the x and y-axes, or the xy-plane. Contacts 30 extend laterally from one side of post 70 along a direction parallel to the x-axis, and are arrayed along the y-axis. Connector post 70 includes a tapered leading portion 71 that tapers in an upward direction, or along the z-axis. Contacts 30 are outwardly spring biased from connector post 70.

Figure 5:
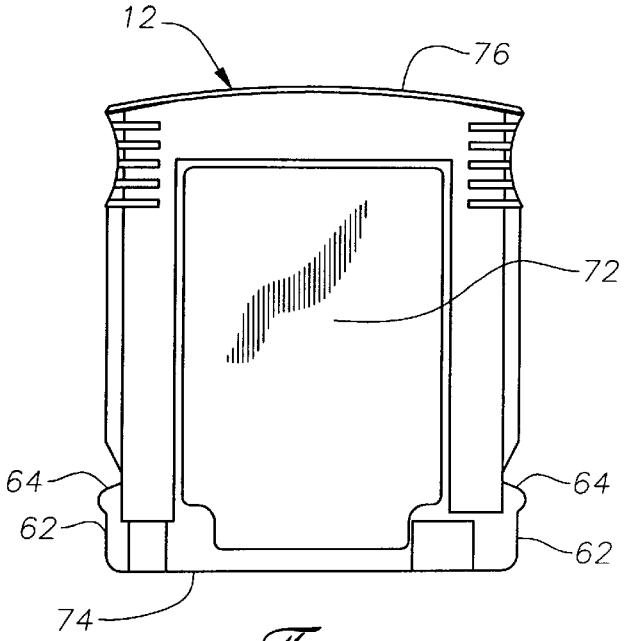
FIG. 5 is a front view of the ink container of FIG. 1.
Figure 6:
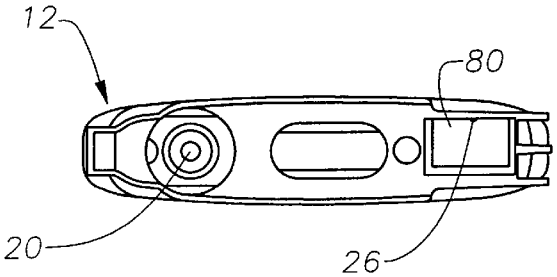
FIG. 6 is a bottom view of the ink container of FIG. 1.

Referring to FIG. 5, ink container 12 includes an outer surface or housing 72 having a leading edge or end 74 and a trailing edge or end 76 relative to the direction of insertion of ink container 12 into receiving station 14 (FIG. 3). As shown in FIGS. 7 and 10, there are four terminals or contacts 24 on the ink container, 24*a* for ground, 24*b* for clocking signals, 24*c* for power, and 24*d* for input and output data. Contacts 24 are located in a small cavity 80 on a lower side of housing 72 adjacent to leading edge 74. Cavity 80 has four perpendicular sidewalls 79.

Referring to FIG. 10, contacts 24 are metal conductive layers disposed on a substrate of electrical insulation material such as epoxy and fiberglass. Four traces or leads 81 are disposed on substrate 78, each extending from one of the contacts 24. Memory device 26 is mounted to substrate 78, and the terminals of memory device 26 are joined to the traces 81. This places memory device 26 in electrical continuity with contacts 24. Adhesive (not shown) is used to encapsulate memory device 26 after its terminals are bonded to traces 81. The substrate, along with contacts 24 and memory device 26, is bonded by adhesive or swaged to a sidewall of cavity 80. Electrical contacts 24 are positioned along the z-axis when ink container 12 is oriented for engagement with receiving station 14.

The entrance to cavity 80 is sized to be small enough to reduce the possibility of fingers from entering cavity 80. The proper sizing of the entrance is important for preventing contamination of contacts 24 during handling of ink container 12. Cavity 80 closely receives one of the connector posts 70. As ink container 12 is inserted into printing system 10, resilient contacts 30 are compressed against contacts 24 to form a low resistance electrical connection between printing system 10 and memory device 26.

When ink container 12 is releasably installed into receiving station 14, tapered portion 71 engages cavity 80 to provide alignment between connector post 70 and cavity 80 such that connector post 70 can partially pass into it. In other words, tapered portion 71 engages the contact surface of a first side and the opposing surface on a second side, aligning connector post 70 by providing an aligning force in the x-direction. The perpendicular sidewalls 79 also engage tapered portion 71 to provide alignment in the y-direction. Being movably mounted in x and y directions, connector post 70 moves in these directions to provide proper alignment between contacts 24 and 30.

When ink container 12 is fully inserted into receiving station 14, spring-loaded contacts 30 provide a contact force along the x-direction which is opposed by an opposing force exerted by connector post 70. Because connector post 70 can float in the x and y-directions, the contact force and opposing force are substantially equal and opposite, such that they provide a substantially minimal or zero net force on connector post 70 and on ink container 12. Minimizing such a lateral force is important, since a lateral x or y force exerted on ink container 12 will tend to interfere with a proper fluidic connection between fluid outlet 20 on the one hand and fluid inlet 28 on the other.

Figure 8:
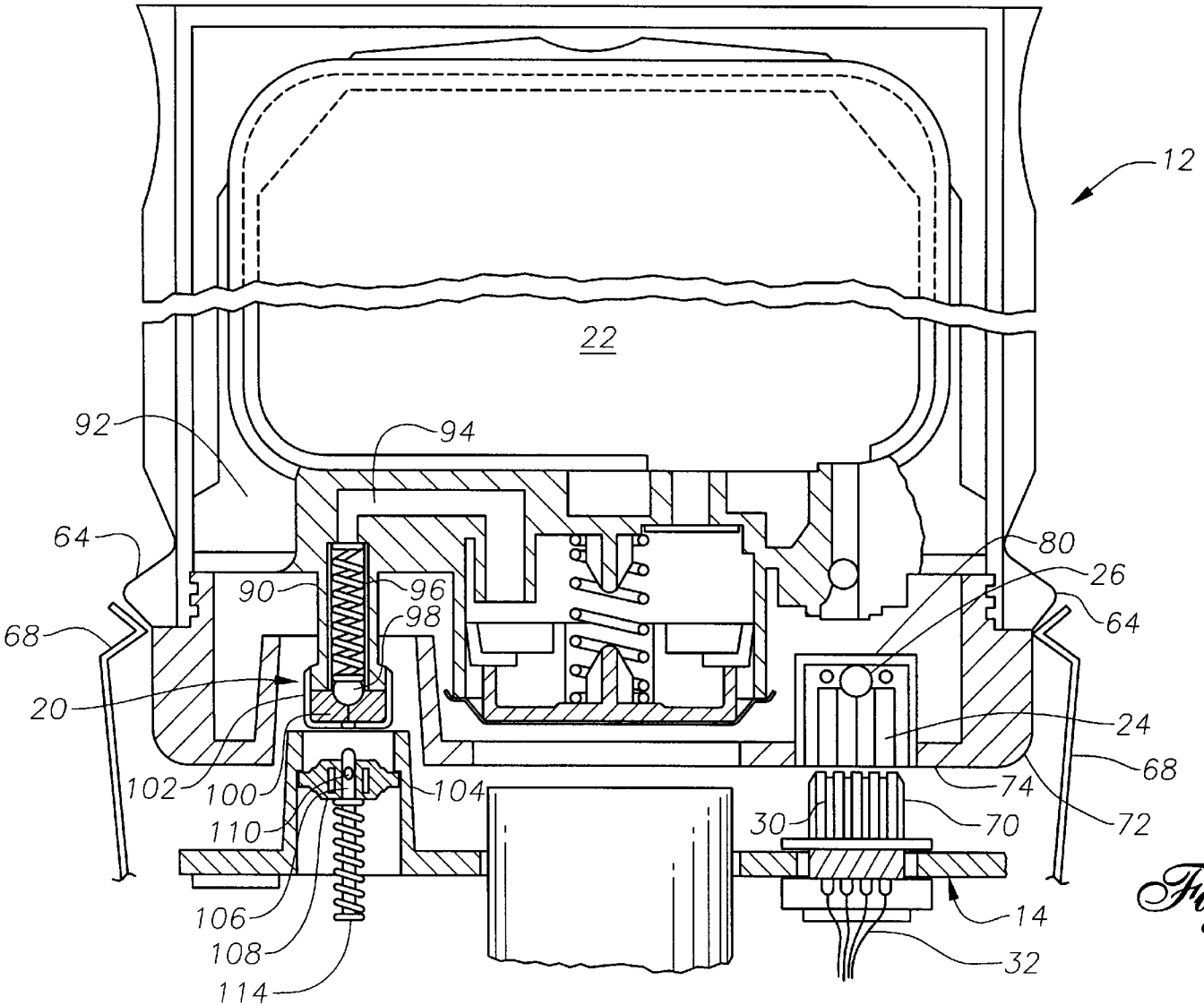
FIG. 8 is a sectional side view of the ink container of FIG. 1, taken along the line 8—8 in FIG. 4 just prior to engaging the ink-jet printing system of FIG. 1.

Referring to FIG. 8, fluid outlet 20 includes a hollow cylindrical tube or boss 90 that extends downward from ink container chassis 92. Boss 90 has an upper end that is fluidically connected to reservoir 22 and a lower end that supports a septum 100. Conduit 94 is joined between boss 90 and ink reservoir 22. In a preferred embodiment, a spring 96 and sealing ball 98 are located within boss 90 and held in place by a compliant septum 100 and a crimp cover 102. Septum 100 is a resilient seal and has a slit that extends through it. Spring 96 biases sealing ball 98 against septum 100 to form a seal.

Fluid inlet 28 on receiving station 14 includes a cylindrical housing 104 surrounding a needle 106. Needle 106 has a blunt upper end, a bore (not shown) and a lateral hole 110 that leads from the bore. The lower end of needle 106 is connected to conduit 21 (FIGS. 1–2) for providing ink to printhead 16. A sliding collar 108 surrounds needle 106 and is upwardly biased by a spring 114. Collar 108 has a compliant sealing portion with an exposed upper surface and an inner surface in direct contact with the needle 106. While in the upper position of FIG. 3, collar 108 seals hole 110 in needle 106. When pushed down to the lower position of FIG. 9, hole 110 of needle 106 inserted through the slit in septum 100 to establish fluid communication between conduit 21 and ink reservoir 22.

Boss 90 is dimensionally sized to be closely received within cylindrical housing 104. The tolerance between the outer diameter of boss 90 and inner diameter of housing 104 assures that the septum 100 can properly engage needle 106. The length of boss 90 must be sufficient for crimp cover 102 to push sliding collar 108 to a lower position to allow ink to flow into port 110 of needle 106.

When ink container 12 is installed into receiving station 14, the crimp cover 102 of boss 90 slides within housing 104 to align septum 100 with respect to needle 106. Needle 106 is then received by septum 100 and pushes ball 98 to a disengaged position. As needle 106 inserts into septum 100, crimp cover 102 depresses collar 108 so that hole 110 is exposed to receive fluid as described above. In the installed position, springs 68 engage latching portion 64 to firmly hold ink container 12 in place.

Figure 9:
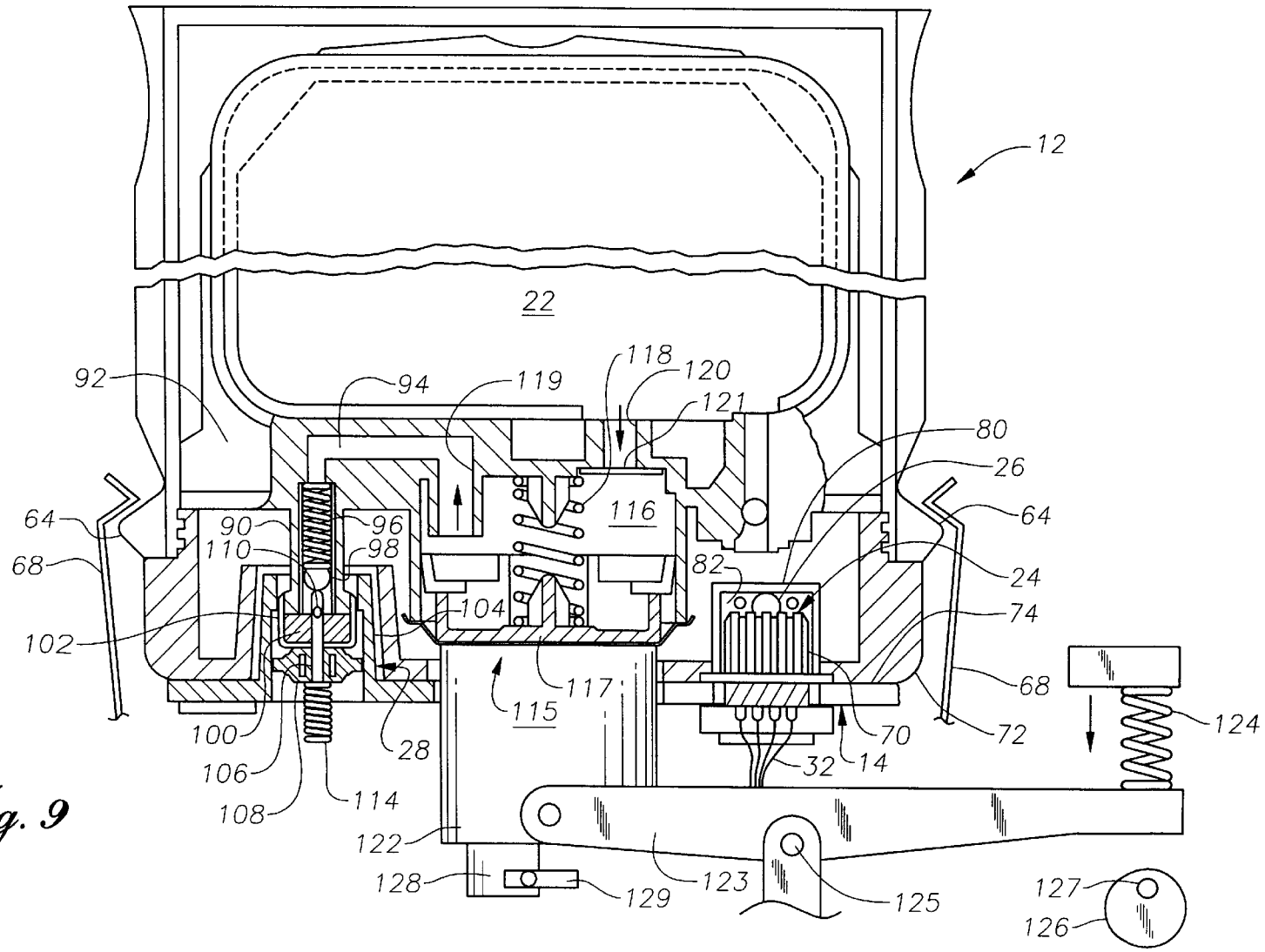
FIG. 9 is a sectional side view of the ink container of FIG. 1 taken along the line 8—8 FIG. 4 and shown fully engaged with the ink-jet printing system of FIG. 1.

Referring to FIG. 9, a pump is incorporated in ink container 12 to assure a desired ink flow rate. Pump 115 is described in co-pending U.S. patent application Ser. No. 08/869,151, filed Jun. 4, 1997, attorney docket number 10970908-1, entitled "Ink Container Configured For Use With A Printing Device Having An Out-Of-Ink Sensing System", all of which material is hereby incorporated by reference. Pump 115 includes a diaphragm 117. Diaphragm 117 is biased downward by a coil spring 118. Pump 115 has a chamber 116 with an outlet 119 and inlet 120 leading to reservoir 22. A valve 121 is located at inlet 120 to prevent outward flow of ink from pump chamber 116 but allow inward flow from reservoir 22. An actuator 122 is reciprocally mounted in printing system station 14 for engaging diaphragm 117. Actuator 122 is pivotally connected to a lever 123. A spring 124 acts on lever 123, which pivots at fulcrum 125 and urges actuator 122 upward. A cam 126 is mounted below lever 123 and is rotatable by a shaft 127. Rotating shaft 127 to an engaged position causes cam 126 to overcome the force of compression spring 124 and move actuator 122 downward to draw in more ink from reservoir 22.

A flag 128 extends downward from the bottom of actuator 122 where it is received within an optical detector 129.

Optical detector 129 directs a beam of light from one leg toward a sensor positioned on the other leg. When actuator 122 is in an uppermost position, flag 128 raises above the beam of light, allowing it to reach the sensor and activate detector 129. In any lower position, flag 128 blocks the beam of light.

Prior to installing ink container 12, actuator 122 will be in its uppermost position, being urged upward by spring 124. After installation, diaphragm 117 will move actuator 122 to the lowermost position. As ink is depleted from the pump chamber, actuator 122 will move upward due to the force of spring 124. When enough ink is depleted from the pump chamber to position actuator 122 at its uppermost position, flag 128 will no longer block the beam of light which can then reach the optical detector 129. In response, the printing system will initiate a refresh cycle. Shaft 127 will rotate cam 126, pulling actuator 122 back to its lowermost position. Diaphragm 117 will move downward due to spring 118, drawing a new supply of ink from reservoir 22 through inlet 120 into pump chamber 116. After a predetermined time interval, shaft 127 rotates cam 126 back to its disengaged position.

If the ink reservoir 22 is out of ink, no ink can enter pump chamber 116 during a refresh cycle. Backpressure within reservoir 22 will prevent the downward movement of diaphragm 117. As a result, when cam 126 is rotated back into its disengaged position, actuator 122 will return to its uppermost position, activating optical detector 129 again. This informs the printing system controller 18 (FIG. 1) that reservoir 22 is out of ink.

Figure 11:
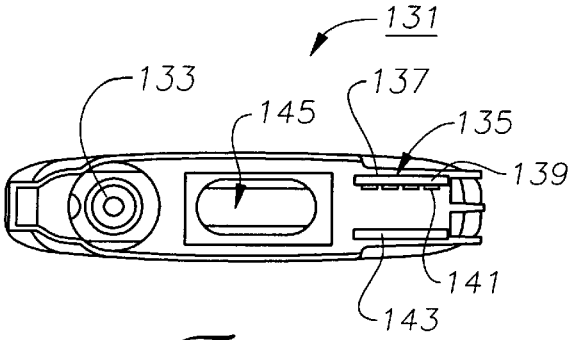
FIG. 11 is a bottom view of a first embodiment of an adaptive ink container constructed in accordance with the invention to be used in place of the original equipment ink container shown in FIGS. 1–10.
Figure 12:
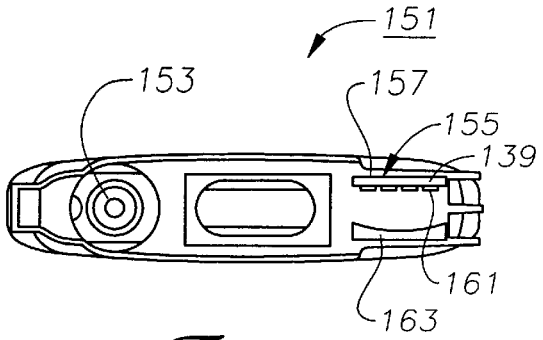
FIG. 12 is a bottom view of a second embodiment of an adaptive ink container constructed in, accordance with the invention.
Figure 13:
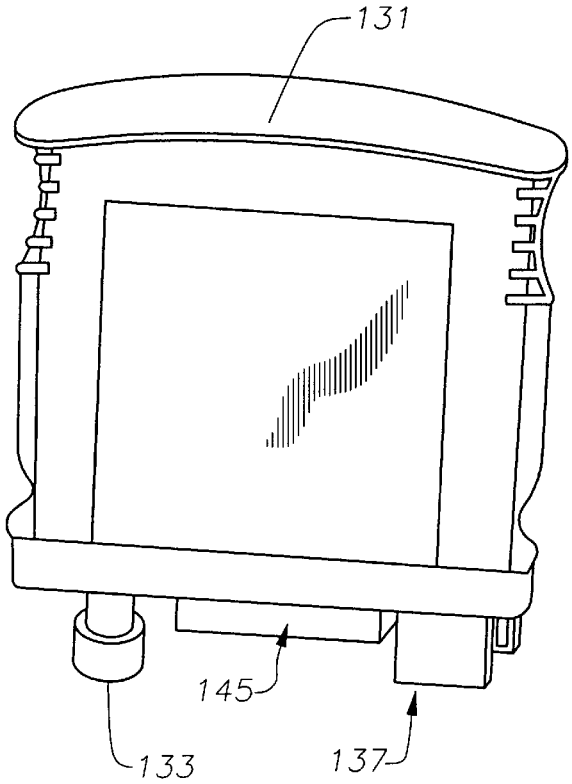
FIG. 13 is a front view of the embodiment of FIG. 11.

FIGS. 11–17 illustrate alternative electrical coupling devices for coupling information storage device 26 to the contacts 30 associated with supply station 14. Referring to FIGS. 11 and 13, a first embodiment has a signal and ink housing or cartridge 131 that is similar to that of cartridge 12. Cartridge 131 has a fluid outlet 133 and an electrical connector 135. Outlet 133 and connector 135 extend downward from a lower side of cartridge 131. Outlet 133 is substantially identical to outlet 20, described above. Connector 135 comprises a first planar vertical member 137 having a rigid support 139 with inner and outer surfaces. A plurality of electrical contacts 141 are mounted to the inner surface of support 139. Contacts 141 are flat, parallel strips which are substantially similar to previously described contacts 24. Contacts 141 are connected to a memory device that is similar to memory device 26. Connector 135 also comprises a second planar vertical member 143 with inner and outer surfaces. Member 143 is parallel to and spaced apart from member 137 by a distance that is approximately equal to a width of connector post 70 (FIG. 10). The inner surface of member 143 is flat and faces in an opposite direction relative to contacts 141. Like support 139, member 143 also serves as a rigid support.

In the embodiment shown, a pump assembly 145 is shown depending from a lower side of cartridge 131. Pump assembly 145 is stroked by actuator 122 (FIG. 9) in the same manner as pump 115. If a pump is not utilized, it would be necessary to provide a retainer device that prevents actuator 122 from moving to its uppermost position. This avoids an out of ink signal occurring due to the position of actuator 122. That device could be the portion of the housing surrounding pump 145 that can be referred to as an "actuator engagement portion".

In operation, cartridge 131 is secured to printing system 10 in a substantially similar manner as cartridge 12. As cartridge 131 is lowered onto receiving station 14 (FIG. 3), outlet 133 engages fluid inlet 28 and connector 135 engages contacts 30 on printing system 10. Connector post 70 (FIG. 10) slides between member 137 and member 143 as cartridge is moved downward into an engaged position. Contacts 141 are forced to slidably engage contacts 30 as member 143 presses against a backside of connector post 70. Pump 145 is engaged by actuator 122 (FIG. 9). As described above for information storage device 26, the memory device contained within cartridge 131 provides ink container-related data to printing system 10.

A second embodiment of an adaptive ink supply is shown in FIG. 12. A signal and ink cartridge 151 is substantially similar to cartridge 131. Cartridge 151 comprises a fluid outlet 153 and an electrical connector 155 having planar vertical members 157, 163. Electrical contacts 161 are mounted to the inner surface of member 157. However, although member 163 is generally parallel to member 157, the inner surface of member 163 differs from that of member 143. The inner surface of member 163 is slightly concave in shape rather than flat. Other than this feature, cartridge 151 is identical to cartridge 131.

In operation, cartridge 151 is secured to printing system 10 in a substantially similar manner as cartridge 131. Cartridge 151 is lowered onto receiving station 14 (FIG. 3), as outlet 153 engages fluid inlet 28 and connector 155 engages contacts 30. Connector post 70 (FIG. 10) slides between member 157 and member 163. Contacts 161 are forced to slidably engage contacts 30 as member 163 presses against a backside of connector post 70. The concave inner surface of member 163 serves to "capture" connector post 70 between members 157 and 163 and better align contacts 161 with contacts 30.

Third, fourth and fifth embodiments of adaptive electrical connectors are depicted in FIGS. 14–16. Like the previous two embodiments, these three embodiments have fluid outlets and connector members which extend downward from a lower side of the cartridge. For example, cartridge 171 (FIG. 14) has an electrical connector 175. However, the contacts 179 of connector 175 are not mounted to a surface. Contacts 179 are curved springs that extend downward directly from cartridge 171. Similarly, cartridge 171 has a backside "support member" which comprises a plurality of curved bias springs 177 that extend downward individually from cartridge 171. Collectively, contacts 179 are parallel to springs 177. The fourth embodiment (FIG. 15) differs from the third embodiment in that backside support member 181 is straight and rigid rather than curved springs. Member 181 is a rigid upstanding member that functions in the same way as member 143 of FIG. 11. The fifth embodiment (FIG. 16) differs from the third embodiment in that the electrical contacts associated with ink container 12 are mounted to an inside surface of rigid support member 183. Rigid support member 183 is similar to support member 137 of FIG. 11.

The third embodiment is operated by lowering cartridge 171 into receiving station 14 (FIG. 3). A fluid outlet (not shown) engages fluid inlet 28 and connector post 70 (FIG. 10) slides between springs 177 and contacts 179. Contacts 179 are forced against and slidably engage contacts 30 as springs 177 press against the backside of connector post 70. The fourth and fifth embodiments operate very similarly to the third embodiment.

An adaptive electrical connector assembly 191 is depicted in FIG. 17. An ink container (not shown) having a fluid outlet similar to fluid outlet 20 (FIG. 1) is used in conjunction with connector assembly 191. An electrical adapter or connector assembly 191 is separate or detached from the ink container housing, but is used to communicate information to printing system 10 concerning the fluid delivered by the fluid outlet. Assembly 191 comprises an electrical connector 193 that connects to an information storage device or emulation device 196. Emulation device 196 is an electronic circuit that functions similar to memory device 26. As described above for the memory device of cartridge 131, it exchanges information with printing system 10 (FIG. 1). For example, emulation device 196 may provide information regarding the volume of ink, the type of ink, color, etc. Emulation device 196 provides information signals indicative of volume and type of ink to controller 18 when connector 19S is connected to connector post 70. In a preferred embodiment, these signals are interpreted by the controller 18 to be indicative of the initial ink supply size, the coarse ink level and the fine ink level. Each time the signal indicative of the fine ink level reaches an extreme, the coarse ink level signal is incremented in emulation device 196 in response. Emulation device 196 thus may be a near duplicate of information storage device 26. Alternatively, emulation device 196 may be a signal-providing circuit that enables printing system 10 to operate whenever a new ink supply is provided. If desired, emulation device 196 may be configured to provide information to printing system 10 which enables it to operate regardless of the actual condition of the ink in the ink reservoir. In addition, emulation device 196 may be located remotely from or immediately adjacent to printing system 10.

Assembly 191 also comprises an adapter connector 195. Adapter connector 195 may be of any one of the embodiments of FIGS. 10–16 and is provided for attachment to connector post 70. In the exemplary embodiment shown, adapter connector 195 has a rigid body with spaced-apart vertical sides 197 that oppose each other. A plurality of contacts 198 are mounted to an inner surface of one of sides 197. A flexible cable 199 extends between electrical connector 193 and adapter connector 195.

In operation, adapter connector 195 is attached to connector post 70 so that contacts 198 slidably engage contacts 30. Vertical sides 197 maintain pressure between contacts 198 and 30. The ink supply is then connected to receiving station 14 (FIG. 3) as described for the embodiments described below. However, instead of an integrally formed electrical connector, these ink supply embodiments utilize external assembly 191 to communicate information to printing system 10.

An alternative connection method between adapter connector 195 and contacts 30 would be to provide permanent electrical coupling between contacts 198 and contacts 30. In this case, the contacts may be joined with a method such as soldering, welding, or mechanically affixing. This permanent connection method can also apply to the electrical contacts shown in FIGS. 10–16. Also in an alternative embodiment, cable 199 may be permanently attached to an information storage device or emulator, eliminating the need for connector 229.

Figure 18:
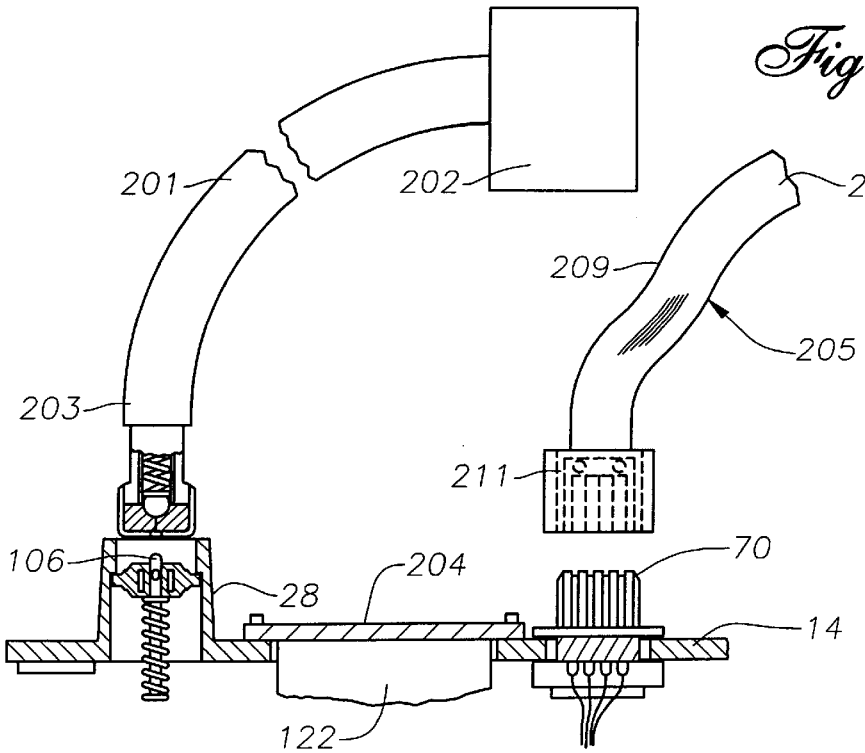
FIG. 18 is a front view of a sixth embodiment of an adaptive ink delivery system constructed in accordance with the invention.

While FIGS. 11–17 deal with alternative adaptive electrical connectors, FIGS. 18–23 show alternative adaptive ink supply systems. Referring to FIG. 18, a sixth embodiment of the invention is designed to provide much larger volumes of ink than the previous ink containers while maintaining the ability to supply the necessary ink information to the printing system. This embodiment has a conduit 201 that replaces the housing of the previous embodiments. Conduit 201 extends from a remotely located ink supply or reservoir 202 and has a fluid outlet 203 that is fluidically connected to fluid inlet 28 in receiving station 14. Ink reservoir 202 may be located remotely from or not immediately adjacent to printing system 10. Ink reservoir 202 can be very large relative to ink container 12 since it is not constrained by receiving station 14 geometry. Additionally, it can be conveniently located. Outlet 203 is constructed similar to fluid outlet 20 (FIGS. 8 and 9) which is described above.

A retainer plate 204 is fastened to printing system station 14, depressing actuator 122 to a lower position. Retainer 204 prevents actuator 122 from moving to its uppermost position, which would result in an erroneous out of ink signal, as explained previously.

This embodiment also comprises an electrical connector assembly 205 which is similar to assembly 191 discussed with respect to FIG. 17. In an exemplary embodiment, assembly 205 includes an electrical connector (not shown) affixed to one end of a flexible cable 209. The electrical connector may be connected to an information storage or emulation device like the one described for FIG. 17. An adapter connector 211 which is similar to connector 195 discussed with respect to FIG. 17 is located on the opposite end of cable 209.

In operation, adapter connector 211 is attached to connector post 70 (FIG. 10) so that its contacts slidably engage the printing system electrical contacts to allow an information storage device or emulator to provide data to printing system 10. Conduit 201 is mounted into receiving station 14 (FIG. 3) by fluidically connecting fluid outlet 203 to fluid inlet 28. Retainer plate 204 is secured to printing system station 14. Thus, this embodiment utilizes separate electrical and large external fluid subassemblies to communicate ink and information to printing system 10.

Figure 19:
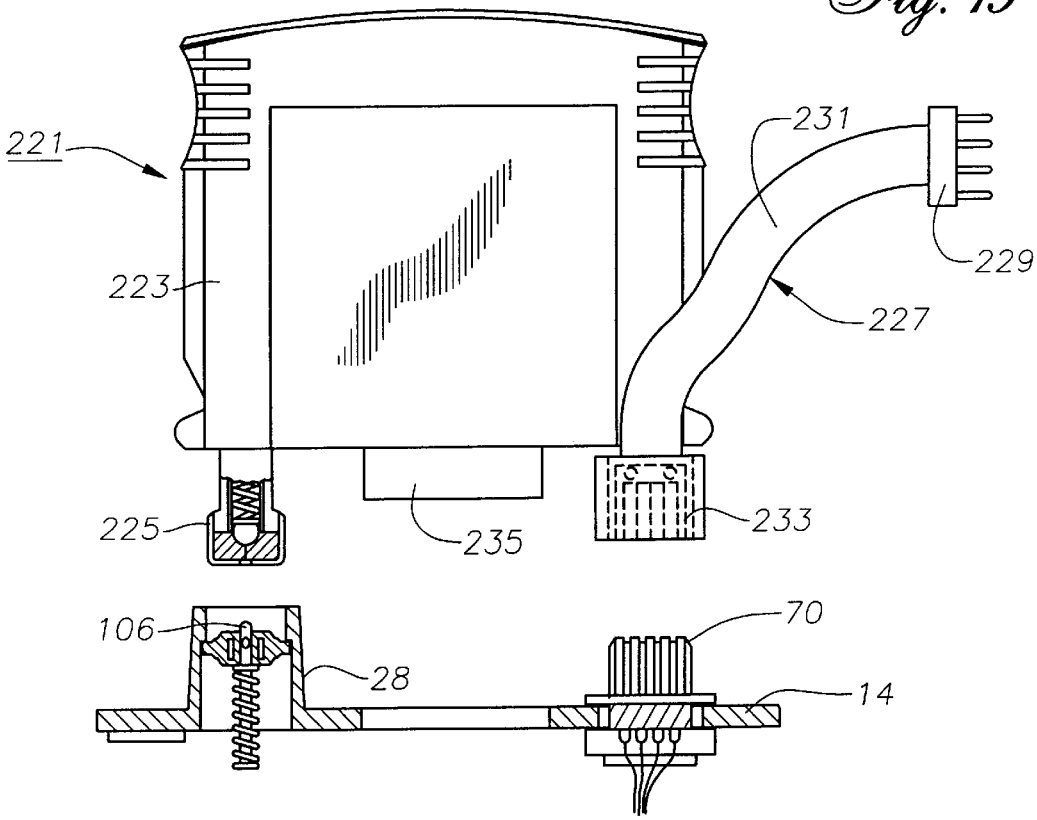
FIG. 19 is a front view of a seventh embodiment of an adaptive ink container constructed in accordance with the invention.

Referring to FIG. 19, a seventh embodiment of an adaptive system is shown. A housing 221 has a reservoir of ink 223 and a fluid outlet 225 similar to fluid outlet 20 (FIGS. 8 and 9) which connects to inlet 28 in receiving station 14 (FIG. 2). A pump assembly 235 may depend from cartridge housing 221 for engagement by actuator 122 (FIG. 18). If a pump is not desired, an actuator engagement portion 235 of housing 221 may serve as a retainer to prevent actuator 122 from moving to its uppermost position. In a preferred embodiment, housing 221 includes guiding and latching features for aligning and securing housing 221 in supply station 14. These features would be the same or similar to those discussed with respect to FIGS. 3–9.

This embodiment also comprises a connector assembly 227 which is similar to assembly 205 discussed with respect to FIG. 18. In an exemplary embodiment, connector assembly 227 has a conventional connector 229, a flexible cable 231, and an adapter connector 233. Connector 229 leads to an information storage or emulation device like that described for FIG. 17. The emulation or memory device need not necessarily be replaced each time ink supply 221 is replaced. Adapter connector 233 is similar to the adapter connector 195 discussed with respect to FIG. 17. As discussed with respect to FIG. 17, connector 233 can take on any of the forms discussed with respect to FIGS. 10–17. Since connector 233 is separate from housing 221, this embodiment utilizes separate external fluid and electrical subassemblies to communicate ink and information to printing system 10.

Figure 20:
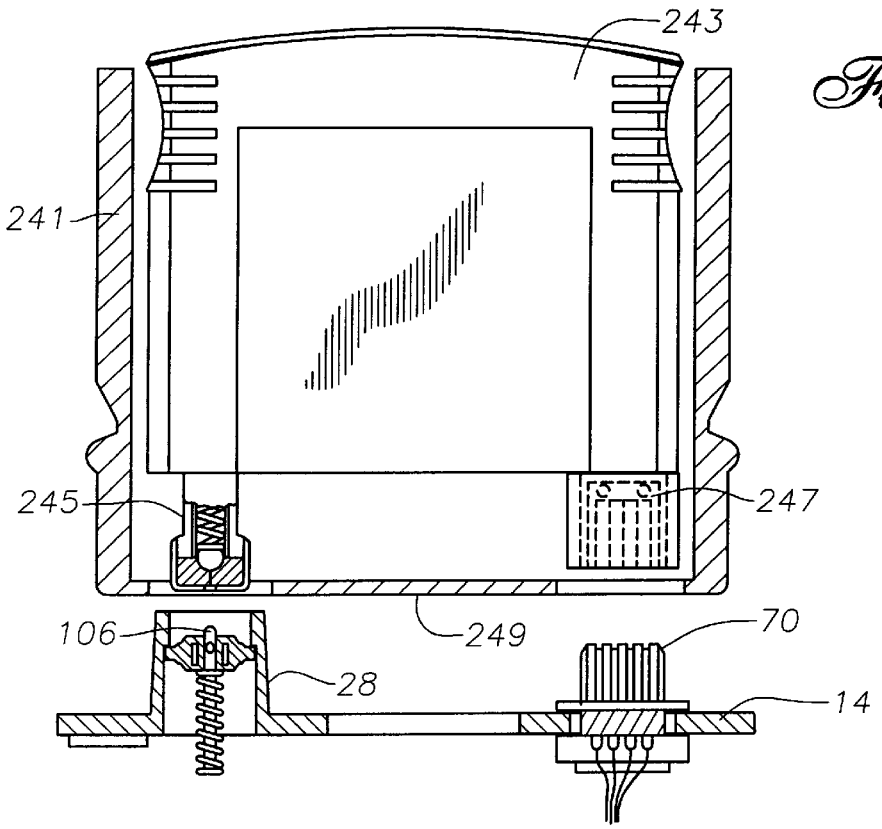
FIG. 20 is a front view of a eighth embodiment of an adaptive ink container constructed in accordance with the invention.

Referring now to FIG. 20, an eighth embodiment of an adaptive system is shown. A housing 241 has a removable and replaceable ink reservoir portion 243 with a fluid outlet 245 which connects to inlet 28 in receiving station 14 (FIG. 2). In the preferred embodiment, housing 241 includes alignment and latching features 62, 64 that function the same as those illustrated with respect to FIG. 3. Housing 241 has an internal connector 247 having a plurality of contacts for slidably engaging contacts 30. Connector 247 may be similar to any of the connectors of FIGS. 10–16. Connector 247 may also have an emulation device like the one described for FIG. 17 mounted to housing 241 or external to housing 241. Advantageously, the emulation device need not necessarily be replaced each time ink reservoir portion 243 is replaced.

Actuator 122 (FIG. 9) will not be able to engage a pump located in reservoir portion 243. An actuator engagement portion 249 of the leading or lower end of housing 241 will depress actuator 122 to prevent it from moving to its uppermost position. This allows printing to occur when ink is present in reservoir 243. In operation, housing 241 is removably secured to fluid inlet 28 and contacts 30 in receiving station 14 as described for the alternate embodiments.

Figure 21:
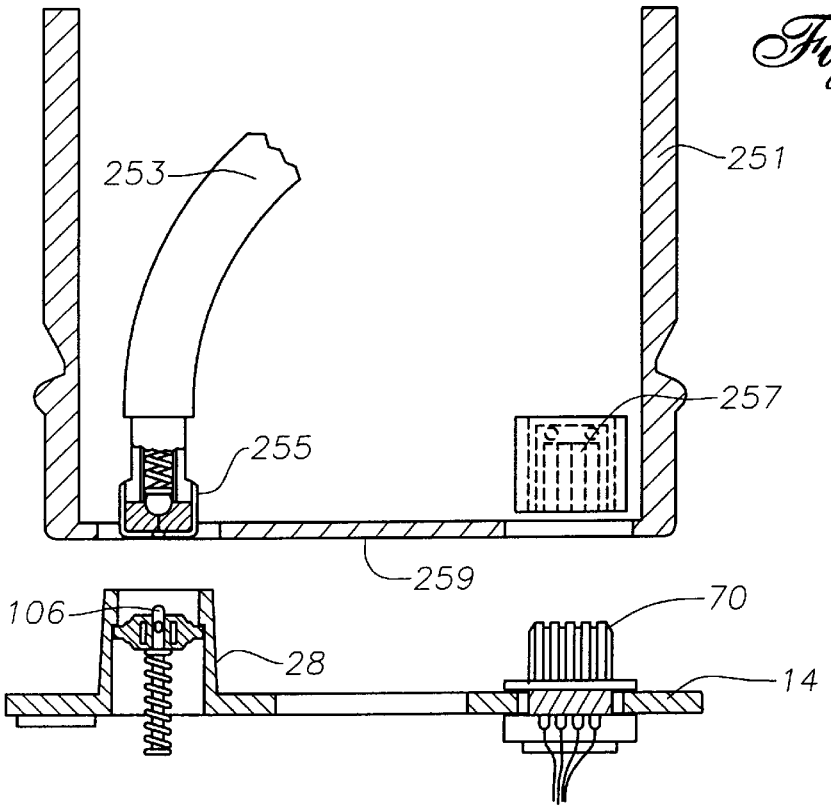
FIG. 21 is a front view of a ninth embodiment of an adaptive ink container for larger volumes of ink and is constructed in accordance with the invention.

A ninth embodiment of an adaptive system is shown in FIG. 21. Like the embodiment of FIG. 18, this embodiment is designed to provide much larger volumes of ink than the previous ink containers while maintaining the ability to supply the necessary ink information to the printing system. A housing 251 has a conduit 253 that is fluidically coupled to a remotely located reservoir of ink that is similar to the one described with respect to FIG. 18. Conduit 253 has a fluid outlet 255 that connects to inlet 28 in receiving station 14 (FIG. 2). Housing 251 has an electrical connector 257 that contains a plurality of contacts for slidably engaging electrical contacts 30 of connector post 70. Like connector 247, connector 257 may comprise or utilize any of the previously described connectors described with respect to FIGS. 10–16. Connector 257 is electrically coupled to an information storage device or an emulator circuit. An actuator engagement portion of the lower end 259 of housing 251 serves as a retainer to prevent actuator 122 (FIG. 9) from moving to its uppermost position. When housing 251 is removeably secured to receiving station 14, fluid outlet 255 connects to fluid inlet 28 and connector 257 connects to contacts 30.

Figure 22:
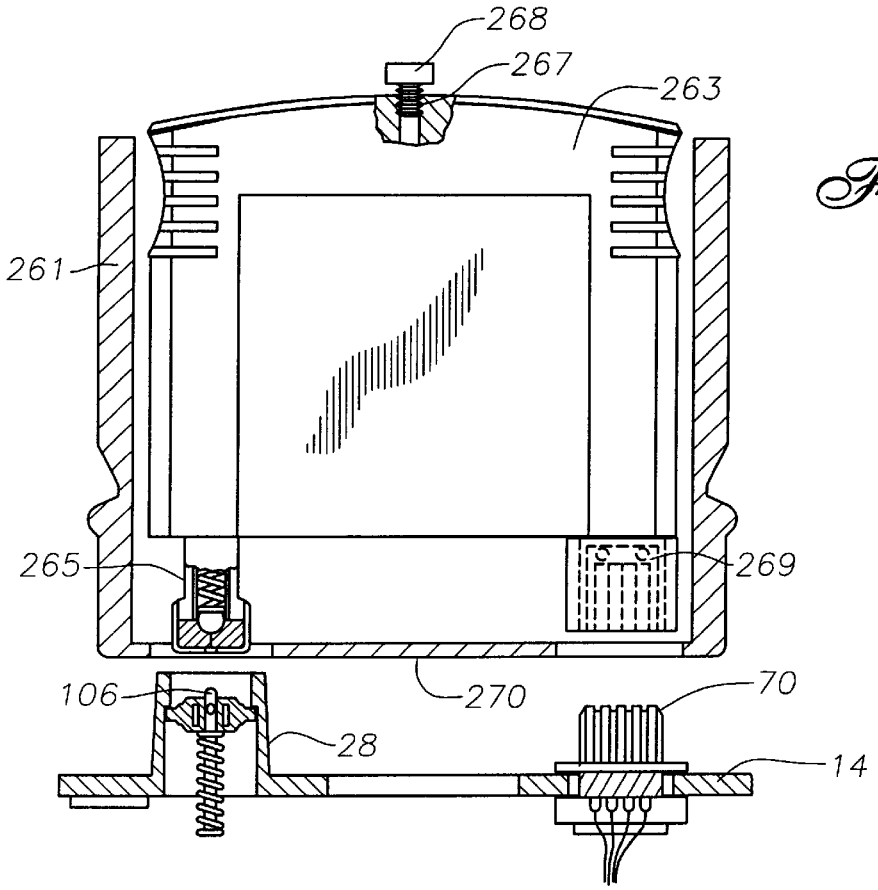
FIG. 22 is a front view of a tenth embodiment of an adaptive ink container constructed in accordance with the invention.

Referring to FIG. 22, a tenth embodiment of an adaptive system is shown. A housing 261 contains a reservoir of ink 263 and a fluid outlet 265 on a lower end that connects to inlet 28 in receiving station 14 (FIG. 2). Reservoir 263 has an opening 267 on an upper end that is sealed with a removable plug 268. Housing 261 also comprises an electrical connector 269 that is similar to connector 257 of FIG. 21. Like connectors 247 and 257, connector 269 may comprise or utilize any of the previously described connectors or the emulation device. An actuator engagement portion of the lower end 270 of housing serves as a retainer to prevent actuator 122 (FIG. 9) from moving to its uppermost position.

In operation, housing 261 is mounted in receiving station 14 as described above. However, reservoir 263 may also be refilled with ink by removing plug 268, injecting ink into reservoir 263, and replacing plug 268. For FIGS. 20–22, adapters are shown for connecting a single supply of ink to a single fluid inlet. However, an adapter like that described in any or all of FIGS. 20–22 could be designed that spans multiple ink containers in supply station 14.

Figure 23:
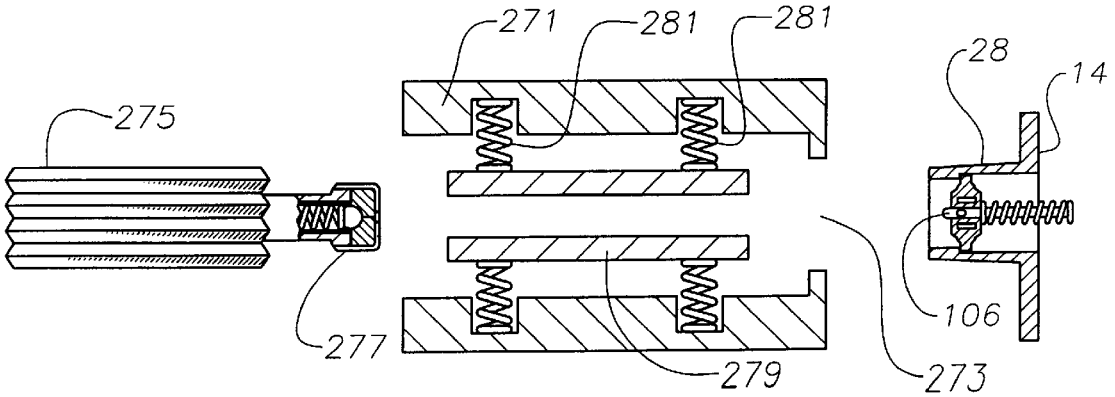
FIG. 23 is a partial sectional view of a eleventh embodiment of an adaptive ink container constructed in accordance with the invention.

An eleventh embodiment of an adaptive system is depicted in FIG. 23. In this version, an adapter housing 271 has an opening 273 on a lower end and an open upper end for receiving a reservoir 275 of ink. Reservoir 275 may be collapsed in an accordion-like fashion, and has a fluid outlet 277 on a lower end that inserts through opening 273 in housing 271. Pressure is applied to reservoir 275 when it is inserted into housing 271 by a pair of piston or pressure plates 279. In the embodiment shown, plates 279 are biased inward from the sidewalls of housing 271 by compressed springs 281. Housing 271 also has an electrical connector (not shown) for engaging electrical contacts 30 (FIG. 2). In operation, housing 271 is mounted in receiving station 14 as described above. As the ink in reservoir 275 is depleted, reservoir 275 is collapsed by plates 279 so that an adequate outlet pressure is maintained for supplying ink to printing system 10.

Any of the ink delivery systems described above can have the same first ink composition as the initial or first ink container 12 or a different second ink composition or ink type, such as an ink having a different color, density, pigment, solvent, surfactant, or ink component ratio. The emulator or second information storage device 26 associated with the different ink composition can provide the printing system with information indicative of the change in ink composition or type. In a preferred embodiment, this information may trigger a warning to the user to assure that the user is aware of the ink composition or ink type change.

The invention has several advantages. The ink delivery systems described allow users who require high usage to replace the ink containers less frequently. These systems supply larger volumes of ink to ink-jet printing systems while maintaining the quality of the electrical interconnect between the ink container and the printing system. The adaptive ink supplies have the advantage of enabling a single printing system to address a wide range of ink usage requirements. Further, by providing an electronic portion, the adaptive ink supply can allow the printing system to automatically adjust printing system function in response to ink supply related information, such as initial deliverable ink volume or ink type.

What is claimed is:

1. An adaptive ink supply for use with a printer in substitution of a first ink cartridge, the first ink cartridge having a pump and a first memory device containing data concerning ink in the first ink cartridge, the printer having a fluid inlet, an actuator which is movable between first and second positions and is urged toward the second position to apply pressure to the pump, a controller which exchanges information with the first memory device, and an electrical connector electrically connected to the controller and having a protruding post, the post having a plurality of electrical contacts which protrude laterally from a first side of the post for connection to contacts associated with the first memory device, the adaptive ink supply comprising:

an ink reservoir for containing a replacement ink;

a fluid outlet in fluid communication with the ink reservoir for releasably coupling to the fluid inlet for supplying the replacement ink to the printer;

an adapter connector having a plurality of electrical contacts for engaging the electrical contacts on the first side of the post;

a retainer for contact with the actuator for preventing the actuator from moving to the second position, the retainer forming part of the adaptive ink supply useable in substitution of the first ink cartridge; and a signal source for providing electronic enabling information signals, wherein the signal source is connected to the contacts of the adapter connector for providing electronic enabling information signals to the controller.

2. The ink supply of claim 1, further comprising:

a housing having the fluid outlet on a lower side which mates with the fluid inlet on the printer; wherein the adapter connector is mounted to and extends downward from the lower side of the housing.

3. The ink supply of claim 1, further comprising:

a housing having the fluid outlet on a lower side which mates with the fluid inlet on the printer; wherein the retainer is an actuator engagement portion of the housing.

4. The ink supply of claim 1, further comprising:

a housing, the adapter connector depending from a lower side of the housing; and wherein the signal source comprises a memory device mounted to the housing.

5. The ink supply of claim 1, wherein the signal source is configured to provide electronic enabling information signals to the printer regardless of the actual volume and characteristics of the replacement ink.

6. The ink supply of claim 1, and further including a flexible cable for connecting the signal source to the adapter connector to provide the electronic enabling information signals while located remotely from the printer.

7. The ink supply of claim 1, and further including a conduit for connecting the ink reservoir to the fluid outlet to enable the reservoir to be located remotely from the printer.

8. The ink supply of claim 1, further comprising:

a support surface located opposite and spaced apart from the electrical contacts of the adapter connector for engaging a second side of the post opposite of the first side for facilitating continuity between the electrical contacts of the post and adapter connector.

* * * * *